US008020827B2

(12) United States Patent
Schieren

(10) Patent No.: US 8,020,827 B2
(45) Date of Patent: Sep. 20, 2011

(54) SUSPENDABLE BLOW DRYER HOLDER

(76) Inventor: Susan M. Schieren, Leeds, NY (US)

( * ) Notice: Subject to any disclaimer, the term of this patent is extended or adjusted under 35 U.S.C. 154(b) by 0 days.

(21) Appl. No.: 12/566,756

(22) Filed: Sep. 25, 2009

(65) Prior Publication Data

US 2011/0073735 A1 Mar. 31, 2011

(51) Int. Cl.
*A47H 1/10* (2006.01)

(52) U.S. Cl. ..... 248/317

(58) Field of Classification Search ..... 248/317, 248/318, 339, 342, 176.2; 34/283, 487, 90, 34/97

See application file for complete search history.

(56) References Cited

U.S. PATENT DOCUMENTS

| | | | | |
|---|---|---|---|---|
| 1,344,027 | A | 6/1920 | Evilsizor et al. | |
| 1,396,507 | A | 11/1921 | Coffman | |
| 2,565,315 | A | 8/1951 | Lieberman | |
| 4,121,720 | A | 10/1978 | Hayes | |
| D274,394 | S * | 6/1984 | Elliott | D6/403 |
| 4,453,695 | A | 6/1984 | Sennott et al. | |
| 4,506,475 | A * | 3/1985 | Elliott | 47/67 |
| 4,561,547 | A | 12/1985 | Estwanik, III | |
| 4,728,016 | A | 3/1988 | McPhee | |
| 5,090,653 | A * | 2/1992 | Theodorides | 248/317 |
| 5,640,781 | A | 6/1997 | Carson | |
| 5,832,624 | A | 11/1998 | Narrin | |
| 6,273,277 | B1 | 8/2001 | Geldenhuys | |
| D482,490 | S | 11/2003 | Fickas et al. | |
| 2008/0016712 | A1 | 1/2008 | Van | |
| 2009/0121108 | A1 * | 5/2009 | McFadden | 248/318 |

FOREIGN PATENT DOCUMENTS

DE 20101519 1/2001

* cited by examiner

*Primary Examiner* — Ramon O Ramirez

(74) *Attorney, Agent, or Firm* — Schmeiser, Olsen & Watts, LLP

(57) ABSTRACT

A suspendable blow dryer holder includes a lower frame having a first opening located within the bounds of the lower frame, the first opening dimensioned to accept and secure a barrel of a first blow dryer such that the barrel is pointed at a floor when the suspendable blow dryer holder is suspended. The suspendable blow dryer holder includes an upper component having a connection mechanism, the connection mechanism configured to connect the suspendable blow dryer holder to a suspending mechanism. Finally, the suspendable blow dryer holder includes a plurality of elongated connecting elements attached to the upper component and extending to a perimeter of the lower frame, the plurality of elongated connecting elements each attached to the perimeter of the lower frame at a connection location, the plurality of elongated connecting elements each having a sufficient length for the first blow dryer to fit between the upper component and the lower frame when the suspendable blow dryer holder is suspended, the connection locations on the perimeter of the lower frame spaced apart for the first blow dryer to fit between at least two of the plurality of elongated connecting elements.

18 Claims, 4 Drawing Sheets

SUSPENDABLE BLOW DRYER HOLDER

FIELD OF THE INVENTION

The subject matter disclosed herein relates generally to a method and apparatus for drying hair. More particularly, the subject matter relates to a suspendable holder for a blow dryer device.

BACKGROUND OF THE INVENTION

Each day millions of people use blow dryers in order to dry their hair more quickly after showering, bathing, or swimming. Blow dryer devices are designed to blow hot air from a barrel of the device into the hair of a user of the device. Depending on the length and thickness of hair and the power of the blow dryer device, a person may blow dry their hair for thirty minutes or more. A user is typically required to hold the blow dryer device with one arm above their head for an extended period in order to direct the air from the blow dryer into their hair. This requirement is a particular problem when a person is unable to move their arm or arms above their head due to weakness, an injury or a disability. Furthermore, holding a blow dryer for any period may be inconvenient, as one or both hands are required to be occupied during the entire blow drying process.

Thus, a suspendable blow dryer holder apparatus and method of use thereof would be well received in the art.

BRIEF DESCRIPTION OF THE INVENTION

According to one aspect of the invention, a suspendable blow dryer holder comprises: a lower frame having a first opening located within the bounds of the lower frame, the first opening dimensioned to accept and secure a barrel of a first blow dryer such that the barrel is pointed at a floor when the suspendable blow dryer holder is suspended; an upper component having a connection mechanism, the connection mechanism configured to connect the suspendable blow dryer holder to a suspending mechanism; and a plurality of elongated connecting elements attached to the upper component and extending to a perimeter of the lower frame, the plurality of elongated connecting elements each attached to the perimeter of the lower frame at a connection location, the plurality of elongated connecting elements each having a sufficient length for the first blow dryer to fit between the upper component and the lower frame when the suspendable blow dryer holder is suspended, the connection locations on the perimeter of the lower frame spaced apart for the first blow dryer to fit between at least two of the plurality of elongated connecting elements.

According to another aspect of the invention, a suspendable blow dryer holder apparatus comprises: a lower frame having a structural first opening within the bounds of the lower frame, the first opening configured to accept and secure a first blow dryer having a substantially circular barrel such that the barrel is pointed at a floor when the suspendable blow dryer holder is suspended, the lower frame having a structural second opening distinct from the first opening and within the bounds of the lower frame, the second opening configured to accept and secure a second blow dryer having a substantially elongated barrel such that the barrel is pointed at a floor when the suspendable blow dryer holder is suspended; an upper component having a connection mechanism, the connection mechanism configured to connect the suspendable blow dryer holder apparatus to a suspending mechanism; and an elongated connecting elements attached to the upper component and extending to the lower frame at a connection location, the elongated connecting element having a sufficient length for the first and second blow dryers to fit between the upper component and the lower frame when the suspendable blow dryer holder is suspended.

According to yet another aspect of the invention, a suspendable blow dryer holder apparatus comprises: a frame comprising: a circular outer frame; a first opening frame connected to the outer frame and extending within the planar bounds of the outer frame, the first opening frame having a profile dimensioned to accept and secure a substantially circular barrel of a blow dryer such that the barrel is pointed at a floor when the suspendable blow dryer holder is suspended; and a second opening frame connected to the outer frame and extending within the planar bounds of the outer frame, the second opening frame having a profile dimensioned to accept and secure an elongated barrel of a blow dryer such that the barrel is pointed at a floor when the suspendable blow dryer holder is suspended; wherein the frame is suspendable from an adjustable suspending mechanism that is attached to a ceiling or wall such that the suspendable blow dryer may be adjustably suspended from different distances from the floor.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
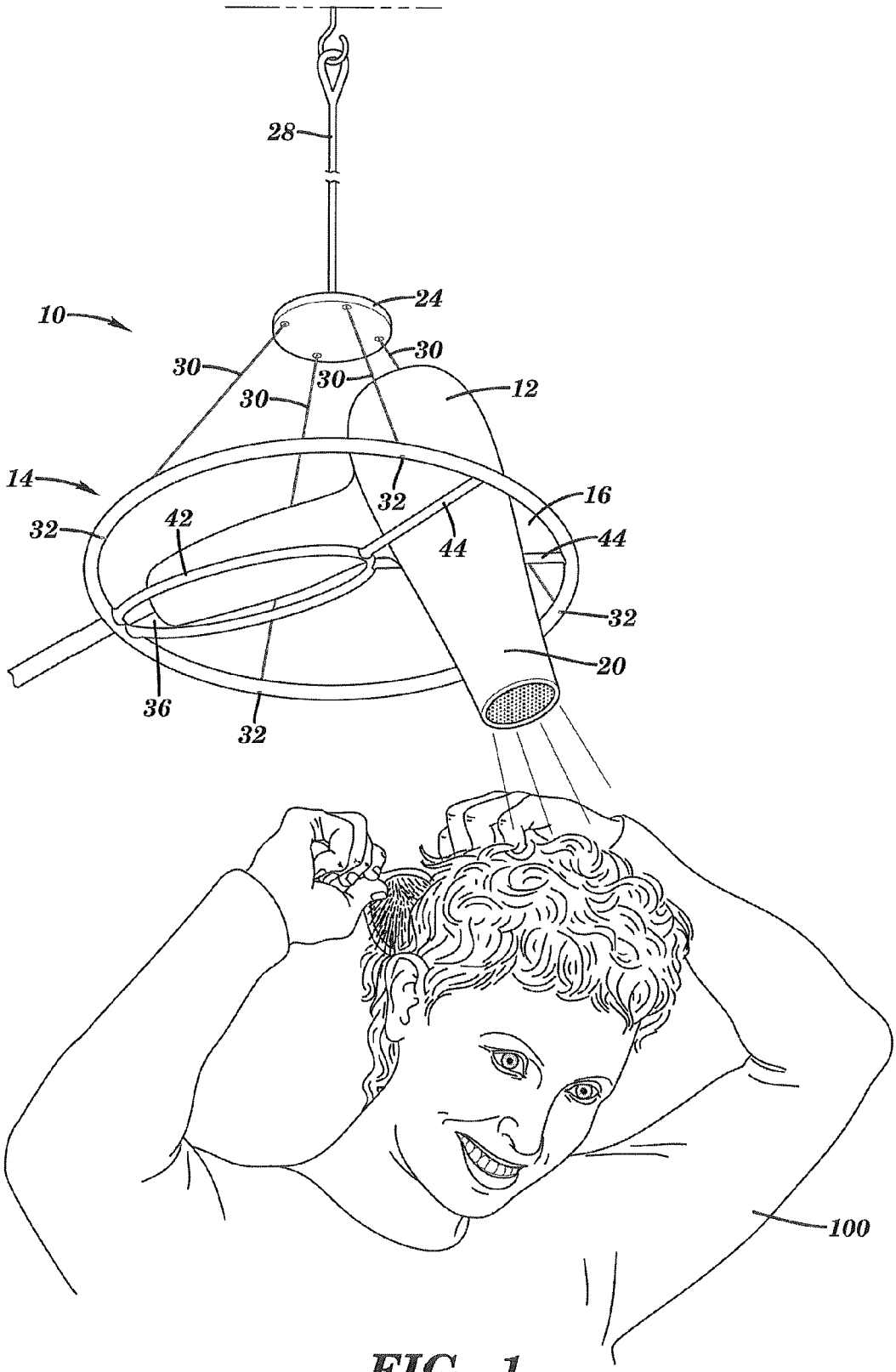
FIG. 1 depicts a perspective view of a suspendable blow dryer holder holding a blow dryer having a substantially circular barrel in accordance with one embodiment of the present invention.

Referring firstly to FIG. 1, there is shown a perspective view of a suspendable blow dryer holder 10 holding a first blow dryer 12 in accordance with one embodiment of the invention. The suspendable blow dryer holder 10 includes a lower frame 14 having a first opening 16 located within the bounds of the lower frame 14. The first opening 16 is configured to accept and secure a barrel 20 of the first blow dryer 12 such that the barrel 20 is securely pointed at a floor (not shown) when the suspendable blow dryer holder 10 is suspended, as shown in FIG. 1. The suspendable blow dryer holder 10 also includes an upper component 24 having a connection mechanism 26 (shown in FIG. 4). The connection mechanism 26 is configured to connect the suspendable blow dryer holder 10 to a suspending mechanism 28. A plurality of elongated connecting elements 30 attach to the upper component 24 and extend to the perimeter of the lower frame 14. The plurality of elongated connecting elements 30 each attach to the perimeter of the lower frame at a connection location 32. The connection locations 32 are spaced apart on the perimeter of the lower frame 14 such that the first hair blow dryer 12 fits between at least two of the plurality of elongated connecting elements 30. Furthermore, the plurality of elongated connecting elements 30 each have a sufficient length for the first blow dryer 12 to fit between the upper component 24 and the lower frame 14 when the suspendable blow dryer holder 10 is suspended. Thus, a person 100 may turn on the first blow dryer 12 and stand below the suspendable blow dryer holder 10 and position their hair into the path of the hot air emerging from the barrel 20 of the first blow dryer 12. This allows the person to dry their hair without having to hold the first blow dryer 12 in their hand and to utilize both hands during the drying process.

It should be understood that the term "accept" refers herein to inserting a barrel of a blow dryer into a structurally bounded opening, such as the first opening 16, so that a substantial portion of the barrel is located below the opening while the remaining body of the blow dryer is located above. In this position, the remaining body of the blow dryer may rest on the structural bound of the opening. Likewise, the term "secure" refers herein to a blow dryer having a barrel accepted into the opening and being prevented from falling through, or otherwise moving. A "secure" blow dryer may be subject to downward or horizontal force and stay in the accepted and secured position. A user may be required to purposefully and carefully remove the barrel of the blow dryer from the opening in the same manner in which it was inserted in order to unsecure a secured blow dryer.

Figure 2:
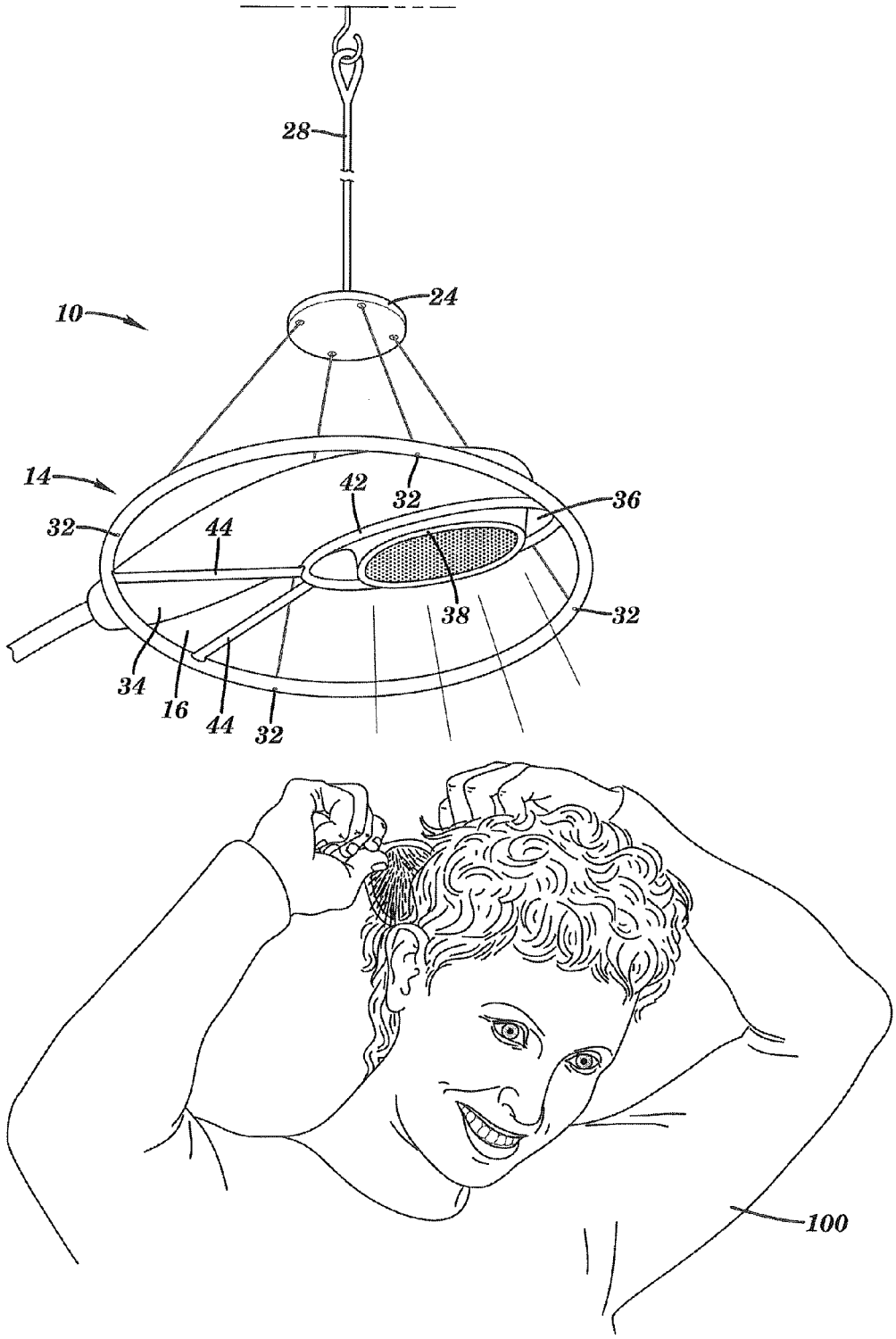
FIG. 2 depicts a perspective view of the suspendable blow dryer holder of FIG. 1 holding a blow dryer having an elongated barrel in accordance with one embodiment of the present invention.

Shown in FIG. 2 is a perspective view of the suspendable blow dryer holder 10 of FIG. 1 holding a second blow dryer 34 in a second opening 36. The second blow dryer 34 includes a barrel 38 having substantially different dimensions than the barrel 20 of the first blow dryer 12. The barrel 20 of the first blow dryer 12 is shown having a substantially circular cross section while the barrel 38 of the second blow dryer 34 has a more elongated cross section in comparison to the barrel 20 of the first blow dryer 12. The second opening 36 may be dimensioned differently than the first opening 16 in order to correspond with the dimensions of the barrel 38. This allows the lower frame 14 to accept and secure the barrel 38 of the second blow dryer 34 such that the barrel 38 is securely pointed at the floor (not shown) when the suspendable blow dryer holder 10 is suspended.

Figure 3:
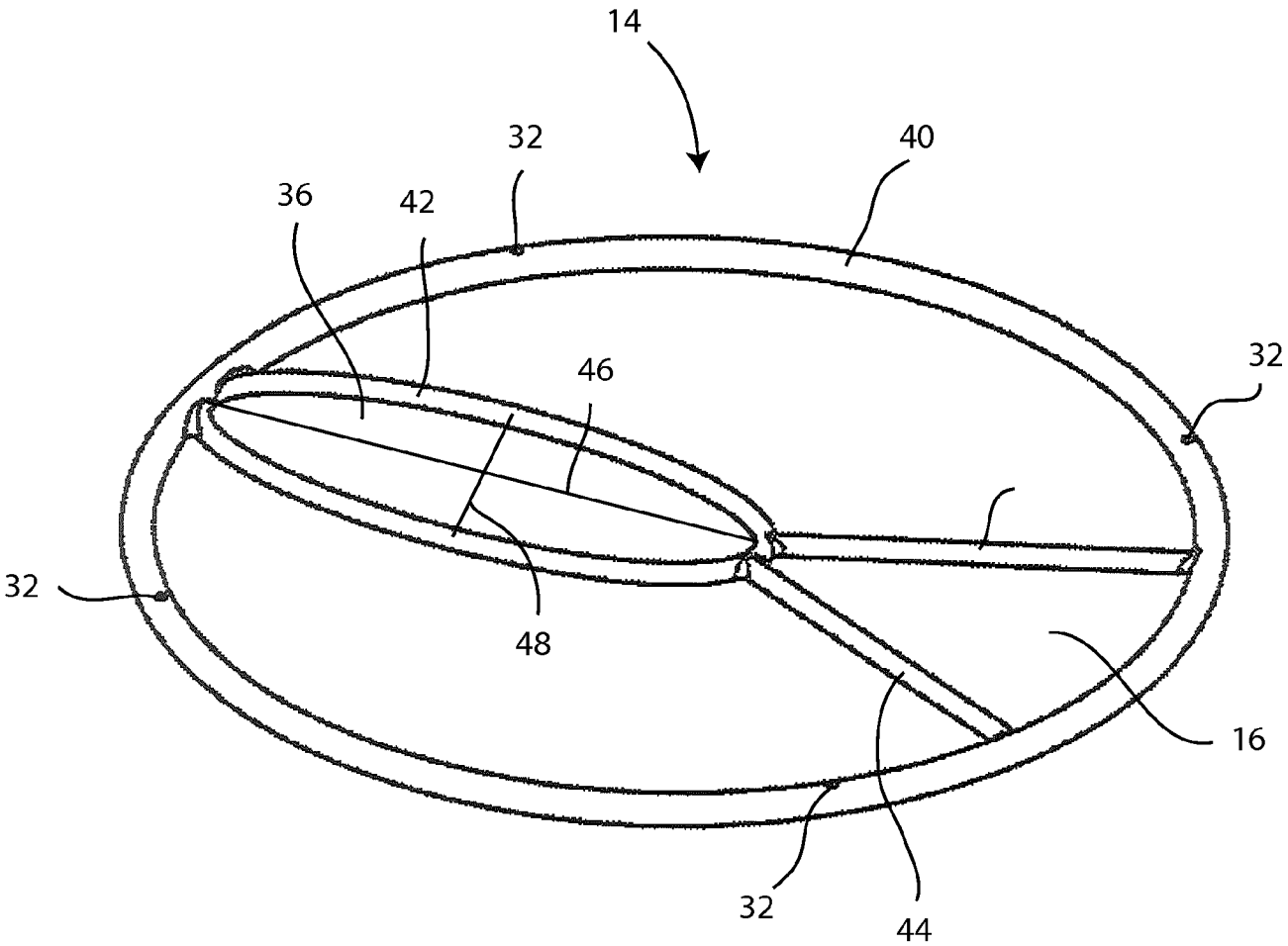
FIG. 3 depicts a perspective view of a lower frame of the suspendable blow dryer holder of FIG. 1 in accordance with one embodiment of the present invention.

Referring now to FIG. 3, a perspective view of the lower frame 14 is shown in accordance with one embodiment of the invention. In the embodiment shown, the lower frame 14 comprises a tubular outer frame 40, a tubular second opening frame 42, and two tubular first opening members 44. The tubular components of the lower frame 14 may be either hollow or solid. It should also be understood that the lower frame 14 may or may not be manufactured or fabricated with tubular components. For example, the lower frame 14 may instead have a solid body with one or more of the openings 16, 36 cut, molded, or otherwise created for holding and securing the barrels 20, 38 of the blow dryers 12, 34. Furthermore, it should be understood that the components 40, 42, 44 of the outer frame 14 may be manufactured or fabricated from any appropriate material such as a plastic or other synthetic, wood, metal, ceramic or combinations thereof. The lower frame 14 may also be fashioned from a transparent material so as to be substantially hidden from view when suspended from a ceiling or wall.

The tubular outer frame 40 is shown to be generally circular, ringed, or annularly shaped as a perimeter around the lower frame 14. However, it should be understood that any perimeter shape may be appropriate. For example, the perimeter of the lower frame 14 may be square, triangular, octagonal, or any other polygonal shape, both equiangular and non-equiangular. Alternately, the lower frame 14 perimeter may be elliptical, oval or other rounded and non-circular shape. As previously described, the outer frame 40 may or may not be a tubular perimeter, but may instead be a more solid structural body, or take any other form that would be apparent to those skilled in the art.

The second opening 36 is shown comprising a second opening frame 42 connected to the outer frame 40 and extending into the planar bounds of the outer frame 40. The second opening frame 42 is elliptical shape or profile and extends planar with the outer frame 40. It should be understood, however, that the second opening frame 42 may not be planar with the outer frame 40 in every embodiment of the present invention. Furthermore, the major axis 46 of the elliptical shaped second opening frame 42 extends through the center of the circular outer frame 40. Furthermore, the major axis 46 and the minor axis 48 and focal points of the ellipse may be particularly dimensioned in order to accommodate blow dryers having an elongated barrel design, such as the barrel 38 of the second blow dryer 34. The dimensions or profile of the second opening frame 42 may accommodate multiple, several, or every single known elongate shaped barrel 38 currently being sold to consumers. It should be understood, however, that the second opening 36 may take other forms than the embodiment shown. For example, the second opening frame 42 may not be directly connected to the outer frame 40, but may be connected instead to a spacing member (not shown). In addition, the second opening frame 42 may not extend directly into the center of the outer frame 40, but instead extend at a different angle, or even extend along the perimeter of the outer frame 40. Moreover, the second opening 36 may take other shapes than the ellipse that is depicted in the figures. For example, the second opening 36 may be a substantially rectangular shape (not shown), square shape, or other shape to accommodate and secure the elongated barrel 38 of the second blow dryer 34.

The first opening 16 of the lower frame 14 is shown to be shaped generally as an isosceles triangle with the outer frame 40 constituting the odd-length "base" of the isosceles triangle shape. The two first opening members 44 constitute the equi-length "legs" of the isosceles triangle shape and extend from the outer frame to the portion of the elliptical second opening frame 42 having the greatest curvature located in the center of the outer frame 40. It should be understood that the first opening 16 may not have an exact isosceles triangle shape, as clearly depicted in the example shown in the Figures having a curved "base." The isosceles shape is meant solely to refer to the equi-length first opening members 44 extending from narrowly spaced connection locations at the second opening frame 42 to the widely spaced connection locations at the outer frame 40. The dimensions of the first opening 16 may accommodate multiple, several, or every single known circular cross section barrel 20 shapes currently being sold to consumers, such as the barrel of the first blow dryer 12. The entirety of the circular cross section barrel 20 may also be considered substantially cylindrical in shape. It should be understood, however, that the first opening 16 may take other forms than the embodiment shown. For example, the first opening 16 may not share a base with the outer frame 40, but may located more centrally within the bounds lower frame 14. In this embodiment a frame of the first opening 16 may be attached to a spacing member (not shown) that extends the frame of the first opening 16 within the lower frame 14. Additionally, the first opening 16 may take other shapes than the isosceles triangle that is depicted in the figures. For example, the first opening 16 may be a substantially circular, rectangular, square, or other shape to accommodate and secure the circular barrel 38 of the second blow dryer 34. Furthermore, like the second opening frame 42, the first opening members 44 may be planar with the outer frame 40. Thus, the entire structure comprising the lower frame 14 may constitute a single plane.

Dimensionally, the outer frame 40 may have a diameter between nine to fifteen inches. In one embodiment, the diameter of the outer frame 40 may be about twelve inches. Furthermore, the major axis 46 of the elliptical second frame opening 42 may be between four to ten inches. In one embodiment, the diameter of the major axis 46 of the elliptical second frame opening 42 may be about seven inches. The minor axis 48 of the elliptical second frame opening 42 may be between two to five inches. In one embodiment, the minor axis 48 of the elliptical second frame opening 42 may be about two and a half inches. However, it should be understood that the elliptical second frame opening should be dimensioned to accept and secure one or more blow dryers having an elongated barrel, such as the second blow dryer 34 and the barrel 38. Furthermore, the second frame opening 42 may not be elliptical, but may be a similarly dimensioned rectangle or any other appropriate shape. Furthermore, the distance between the connection points of the first opening members 44 at the outer frame 40 may be between three to six inches. In one embodiment this distance may be about 4.2 inches. The distance between the connection points of the first opening members 44 at the second opening frame may be from zero to two inches. In other words, the first opening members 44 may converge to a point. Alternately, a single V-shaped first opening member (not shown) may alternately be attached to the second opening frame 42 and the outer frame 40. In embodiments where the first opening 16 is not triangular in shape, an alternate shape may have similar dimensions to similarly accept and secure the barrel of a circular shaped blow drier, such as the first blow drier 12 and the barrel 20. Whatever the embodiment, it should be understood that a first area defined by the outer frame 40 may be substantially larger than a second area defined by one of the openings 16, 36.

The lower frame 14 also includes a plurality of connection locations 32 for connecting the elongated connecting elements 30. The connection locations 32 may be equispaced about the perimeter of the outer frame 40 of the lower frame 14. An equispaced configuration may help provide stability to the assembled suspendable blow dryer holder 10. However, other non-equispaced embodiments are contemplated. The connection locations may be simple tie locations and not have any structural difference with the remainder of the outer frame 40. Alternately, the lower frame 14 may be fabricated with holes or other appropriate structures to facilitate the connection of the elongated connecting elements 30. The connection locations 32 may be weld locations or melting locations in the case that the elongated connecting elements 30 and the lower frame 14 are each metallic or plastic. Alternately, screws, nails or any other appropriate connection means may be used to connect the elongated connecting elements 30 to the lower frame 14 at the connection locations 32. Moreover, the lower frame 14 includes four connection locations 32 for connecting a corresponding four elongated connecting elements 30. However, more or less connection locations may be desirable depending on the number of elongated connecting elements 30 that are utilized to connect the lower frame 14 to the upper component 24. Any number of connection locations 32 and corresponding elongated connecting elements 30 may be used. In one embodiment, a single connection location 32 is located on the perimeter of the lower frame 14. In this embodiment, the lower frame 14 and the elongated connecting elements 30 may comprise a more robust and rigid material in order to maintain structural integrity during use.

Figure 4:
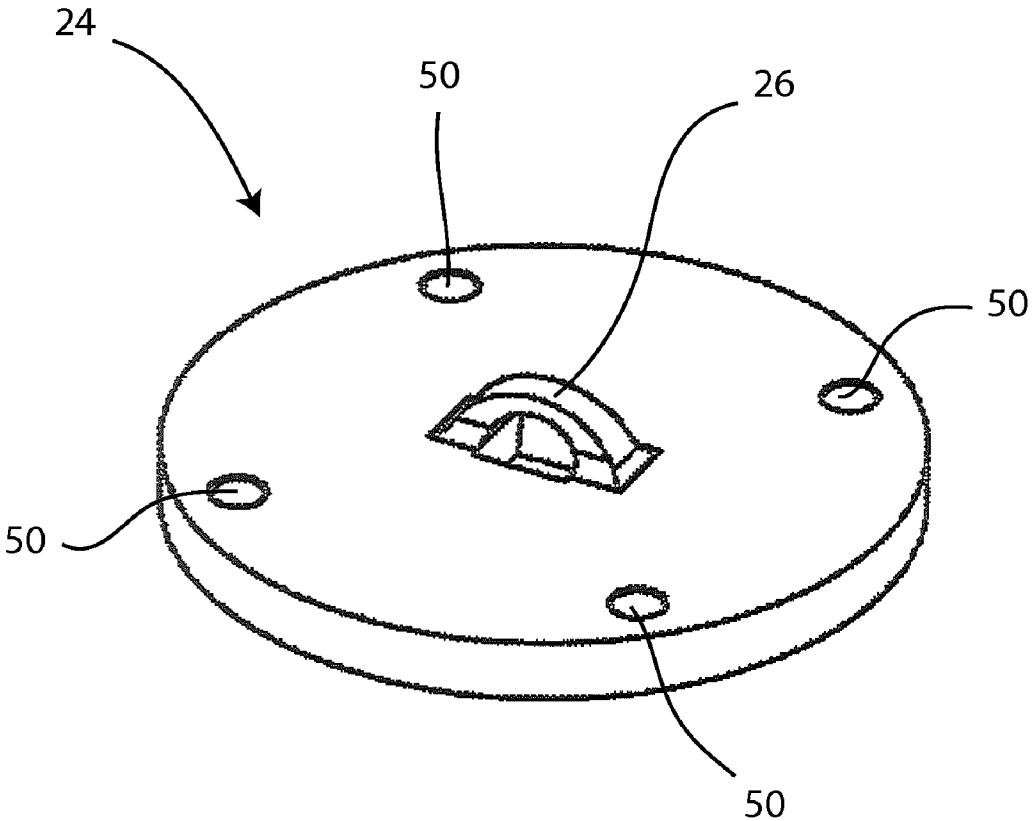
FIG. 4 depicts a perspective view of an upper component of the suspendable blow dryer holder of FIG. 1 in accordance with one embodiment of the present invention.

Referring now to FIG. 4, a perspective view of the upper component 24 of the suspendable blow dryer holder 10 is shown according to one embodiment of the invention. The upper component 24 is shown having a generally circular and solid profile. However, it should be understood that other embodiments are contemplated. For example the upper component 24 may comprise tubular components similar to the embodiment of the lower frame 14 depicted in the Figures. Additionally, the shape of the upper component 24 may take other forms such as a square, triangular, octagonal, or any other polygonal shape, both equiangular and nonequiangular. Alternately, the upper component 24 may be elliptical, oval or other rounded and non-circular shape. Moreover, the upper component 24 may be a simple ring or loop at which both the elongated connecting elements 30 and the suspending mechanism 28 are attached. It should also be understood that the upper component 24 may be fashioned from any appropriate material such as plastic or other synthetic, wood, ceramic, metal, or combinations thereof. Like the lower frame 14, the upper component 24 may also be fashioned from a transparent material so as to be substantially hidden from view when suspended from a ceiling or wall.

The upper component 24 includes the connection mechanism 26. The connection mechanism 26 may be located in the center of the top side of the upper component 24 that is distal to the lower frame 14. The connection mechanism 26 is configured to attach to the suspending mechanism 28 that may be suspended or hung from a ceiling or wall. The connection mechanism 26 may be a simple structural loop in one embodiment, as shown in the Figures. In this embodiment, an S-hook or other connector from the suspending mechanism 28 may be used to attach the connection mechanism 26 to the suspending mechanism 28. In other embodiments, the connection mechanism 26 may be another connecting device such as a fastener, a snapping connector, an adhesive, or another connector that would be apparent to those skilled in the art. In every embodiment, however, the connection mechanism 26 secures the upper component 24 to the suspending mechanism 28 so that the suspendable blow dryer holder 10 is suspended.

The connection mechanism 26 may be configured to attach with a variety of suspending mechanisms 28. While the suspending mechanism shown in FIG. 1 is a pole, other suspending mechanisms are contemplated. For example, the suspending mechanism 28 may be a rope, string, fishing line, plant hanger, chain, or the like. The suspending mechanism 28 may be either draped from a ceiling or extended from a wall. It should be understood that any suspending mechanism 28 that may be used to attach to the connection mechanism 26 to suspend the suspendable blow dryer holder 10 is contemplated. The suspending mechanism 28 may also be adjustable in length so that the length at which the suspendable blow dryer holder 10 is suspended is also adjustable. In this way, a single suspendable blow dryer holder 10 may be utilized by people of varying heights or in rooms with varying ceiling heights.

The upper component 24 also includes a plurality of connection locations 50 at which the elongated connecting elements 30 are attached. The connection locations 50 may be equispaced about the perimeter of the upper component 24. An equispaced configuration may help provide stability to the assembled suspendable blow dryer holder 10. However, other non-equispaced embodiments are contemplated. Additionally, in the case that the upper component is a simple structure ring or loop, each of the elongated connecting elements 30 may be simply tied to the structural loop. The connection locations 50 may be simple tie locations and not have any structural difference with the upper component 24 in the case that the upper component 24 is tubular or otherwise hollow in structure. Alternately, the upper component 24 may be fabricated with holes or other appropriate structure to facilitate the connection of the elongated connecting elements 30. The connection locations 50 may be weld locations or melting locations in the case that the elongated connecting elements 30 and the upper component 24 are each metallic or plastic. Alternately, screws, nails or any other appropriate connection means may be used to connect the elongated connecting elements 30 to the upper component 24 at the connection locations 50. Moreover, the upper component 24 includes four connection locations 50 for connecting a corresponding four elongated connecting elements 30. However, more or less connection locations may be desirable depending on the number of elongated connecting elements 30 that are utilized to connect the lower frame 14 to the upper component 24. Any number of connection locations 50 and corresponding elongated connecting elements 30 may be used as long as the blow dryer 12, 34 fits between at least two of the plurality of elongated connecting elements 30 when the suspendable blow dryer holder 10 is suspended.

Referring back to FIGS. 1 and 2, the elongated connecting elements 30 are shown as a string, chord, rope or strand. This string may be a semi-pliable silicon string having a semi-rigid quality that facilitates in retaining the structural integrity of the suspendable blow dryer holder 10 after a blow dryer has been accepted and secured. Other embodiments of the elongated connecting elements 30 are contemplated such as fishing line, fabric, string, rope, rod, pole, shaft, tubes or the like. The material of the elongated connecting elements 30 may be silicon, rubber, fabric, metal, wood, plastic, a synthetic, or any other appropriate material as will be apparent to those skilled in the art. Furthermore the length of the elongated connecting elements 30 may be substantially equal. Furthermore, the elongated connecting elements 30 have a sufficient length for the first blow dryer 12 to fit between the upper component 24 and the lower frame 14 when the suspendable blow dryer holder 10 is suspended. The elongated connecting elements may retain the lower frame 14 so that it remains substantially parallel with the floor. The elongated connecting elements 30 may provide enough structural support and may have enough spacing between each elongated connecting element 30 such that the lower frame remains supported in this parallel position after a blow drier has been accepted and secured. Furthermore, the elongated connecting elements 30 may secure the upper component 24 so that it likewise remains substantially parallel with the floor both before and after a blow dryer has been accepted and secured.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A suspendable blow dryer holder comprising:

a lower frame having an outer frame and a first opening located within the bounds of the outer frame, the first opening dimensioned to accept and secure a barrel of a first blow dryer such that the barrel is pointed at a floor when the suspendable blow dryer holder is suspended, wherein a first area defined by the outer frame is substantially larger than a second area defined by the first opening, wherein the lower frame includes a second opening located within the bounds of the lower frame and structurally distinct from the first opening, wherein the second opening is configured to accept and secure a barrel of a second blow dryer having different dimensions and shape than the first blow dryer;

an upper component having a connection mechanism, the connection mechanism configured to connect the suspendable blow dryer holder to a suspending mechanism; and a plurality of elongated connecting elements attached to the upper component and extending to a perimeter of the lower frame, the plurality of elongated connecting elements each attached to the perimeter of the lower frame at a connection location, the plurality of elongated connecting elements each having a sufficient length for the first blow dryer to fit between the upper component and the lower frame when the suspendable blow dryer holder is suspended, the connection locations on the perimeter of the lower frame spaced apart for the first blow dryer to fit between at least two of the plurality of elongated connecting elements.

2. The suspendable blow dryer holder of claim 1, wherein the elongated connecting elements secure the upper component and lower frame substantially parallel with the floor when the suspendable blow dryer holder is suspended after the first blow dryer has been accepted and secured.

3. The suspendable blow dryer holder of claim 1, wherein the cross section of the barrel of the first blow dryer is substantially circular in shape and wherein the cross section of the barrel of the second blow dryer is elongated in comparison to the cross section of the first barrel.

4. The suspendable blow dryer holder of claim 1, wherein the first opening is substantially triangular in shape and the second opening is substantially elliptical in shape.

5. The suspendable blow dryer holder of claim 1, wherein the lower frame comprises a tubular structure.

6. The suspendable blow dryer holder of claim 1, wherein each of the plurality of elongated connecting elements are made from a material selected from the group consisting of silicon, rubber, fabric, metal, wood, plastic, rope and string.

7. The suspendable blow dryer holder of claim 1, wherein the connection locations of each of the plurality of elongated connecting elements to the lower frame are equispaced about the perimeter.

8. The suspendable blow dryer holder of claim 1, wherein the outer frame is substantially circular.

9. A suspendable blow dryer holder apparatus comprising:

a lower frame having a structural first opening within the bounds of the lower frame, the first opening configured to accept and secure a first blow dryer having a substantially circular barrel such that the barrel is pointed at a floor when the suspendable blow dryer holder is suspended, the lower frame having a structural second opening having different dimensions, the structural second opening, distinct from the structural first opening and within the bounds of the lower frame, the structural second opening configured to accept and secure a second blow dryer having a substantially elongated barrel such that the barrel is pointed at a floor when the suspendable blow dryer holder is suspended;

an upper component having a connection mechanism, the connection mechanism configured to connect the suspendable blow dryer holder apparatus to a suspending mechanism; and an elongated connecting elements attached to the upper component and extending to the lower frame at a connection location, the elongated connecting element having a sufficient length for the first and second blow dryers to fit between the upper component and the lower frame when the suspendable blow dryer holder is suspended.

10. The suspendable hair blow dryer holder of claim 9, wherein the elongated connecting elements secure the upper component and lower frame substantially parallel with the floor when the suspendable blow dryer holder is suspended after at least one of the first and second blow dryer has been accepted and secured.

11. The suspendable hair blow dryer holder of claim 9, wherein the cross section of the barrel of the first blow dryer is substantially circular in shape and wherein the cross section of the barrel of the second blow dryer is elongated in comparison to the cross section of the first barrel.

12. The suspendable hair blow dryer holder of claim 9, wherein the structural first opening is substantially triangular in shape and the second opening is substantially elliptical in shape.

13. The suspendable hair blow dryer holder of claim 9, wherein the lower frame comprises a tubular structure.

14. The suspendable hair blow dryer holder of claim 9, wherein each of the plurality of elongated connecting elements are made from a material selected from the group consisting of silicon, rubber, fabric, metal, wood, plastic, rope and string.

15. The suspendable hair blow dryer holder of claim 9, wherein the connection locations of each of the plurality of elongated connecting elements to the lower frame are equispaced about the perimeter.

16. The suspendable hair blow dryer holder of claim 9, wherein the perimeter of the lower frame is substantially circular.

17. A suspendable blow dryer holder apparatus comprising:

a frame comprising:

a circular outer frame;

a first opening frame connected to the outer frame and extending within the planar bounds of the outer frame, the first opening frame having a substantially triangular shape; and a second opening frame connected to the outer frame and extending within the planar bounds of the outer frame, the second opening frame having a substantially elliptical shape;

wherein the frame is suspendable from an adjustable suspending mechanism that is attached to a ceiling or wall such that the suspendable blow dryer holder may be adjustably suspended from different distances from the floor.

18. The suspendable blow dryer holder apparatus of claim 17, wherein the lower frame comprises a tubular structure.

* * * * *